United States Patent [19]

Harris

[11] Patent Number: 4,957,022

[45] Date of Patent: Sep. 18, 1990

[54] PIPE SLITTER

[75] Inventor: Michael R. Harris, Plano, Tex.

[73] Assignee: Phillips Petroleum Company, Bartlesville, Okla.

[21] Appl. No.: 319,014

[22] Filed: Mar. 3, 1989

[51] Int. Cl.[5] ..... B26D 3/08

[52] U.S. Cl. ..... 83/16; 83/54; 83/171; 83/401; 83/425; 83/440; 83/856

[58] Field of Search ..... 83/54, 198, 184, 856, 83/425, 431, 435.2, 401, 635, 636, 188, 16, 171, 440; 138/128, 156; 264/146

[56] References Cited

U.S. PATENT DOCUMENTS

| | | | |
|---|---|---|---|
| 284,496 | 9/1883 | Seymour | 83/636 |
| 2,389,376 | 5/1943 | Mandin | 83/636 |
| 3,715,941 | 2/1973 | Andrews et al. | 83/7 |
| 4,160,398 | 7/1979 | Bichot et al. | 83/865 |
| 4,516,460 | 5/1985 | Vizecky | 83/861 |
| 4,781,089 | 11/1988 | Gerber et al. | 83/51 |

FOREIGN PATENT DOCUMENTS

| | | | |
|---|---|---|---|
| 182722 | 7/1955 | Austria | 138/156 |

*Primary Examiner*—Hien H. Phan
*Assistant Examiner*—John M. Husar
*Attorney, Agent, or Firm*—George E. Bogatie

[57] ABSTRACT

Method and apparatus are disclosed for cutting a slit along the length of a pipe in such a manner that expansion of a diameter of the slitted pipe is possible without creating a gap at the slit. This is accomplished by advancing the pipe to be slit past a cutting edge that non-radially traverses the inner and outer circumferences of the pipe wall. In a preferred embodiment the cutting edge, which traverses the pipe wall, is positioned tangentially with respect to the inner circumference of the pipe wall and extends from the inner circumference to intersect the outer circumference of the pipe wall.

15 Claims, 4 Drawing Sheets

PRIOR ART

PIPE SLITTER

This invention relates generally to method and apparatus for cutting a longitudinal slit in a pipe. In one aspect it relates to a cutting tool. In another aspect it relates to a method for slitting a wall thickness of a tubular work piece during a working traverse of the tubular piece past the cutting tool.

BACKGROUND OF THE INVENTION

Since the introduction of plastic pipe, applications have been discovered which require a slit through the wall thickness of generally cylindrical plastic pipe. Cylindrical plastic pipes having an inner diameter and an outer diameter have been slit longitudinally so as to allow the plastic pipe to be flexed open and wrapped around, for example, another generally cylindrical pipe for which it is desired to provide insulation and/or protection. In this application the slit along the length of the pipe is generally made so as to cut through the minimum thickness of pipe wall required to achieve access to the inner surface of the pipe i.e., with reference to a cross-section of the slitted pipe, the slit is in alignment with a radius of the pipe.

While the slit aligned with the radius of the pipe is effective for applications such as providing a cover or insulation for another pipe, when the pipe to be protected has an outside diameter essentially equal to the inside diameter of the protective pipe, this radially aligned slit has certain drawbacks. For example, any expansion of the outside diameter of the protected pipe will cause a gap to appear along the radially aligned slit cut in the protective pipe.

In other applications for use of plastic pipe, expansion of the plastic pipe is required. For example, it is known to utilize relatively short lengths of slitted plastic pipe as insert sleeves to anchor bolts in certain materials such as cement, ceramics, or rock. In this application the slitted pipe may be sized for closely receiving a screw in the bore of the pipe. As the screw is advanced, threads are cut into the interior wall of the plastic pipe, thus forcing expansion of the sleeve into contact with the interior walls of a predrilled hole in which the sleeve has been inserted.

Regardless of whether expansion of the slitted plastic pipe is desired or not, the gap created at the slit by expansion of an object within the slitted pipe can be detrimental by allowing the object within the slitted pipe to contact undesired fluids.

A pipe slit in such a manner that would allow for expansion of the pipe diameter of the slitted pipe without creating a gap at the slit would prove to be a useful article.

Accordingly it is an object of this invention to provide an improved method and apparatus for cutting a slit along the length of a generally cylindrical plastic pipe.

It is a further object of this invention to cut a longitudinal slit in a pipe which will allow a diametrical expansion of the slitted pipe without creating a gap at the slit.

It is still a further object of this invention to provide an improved protective cover for an object contained in the slitted pipe.

SUMMARY OF THE INVENTION

In accordance with the present invention, method and apparatus are provided for achieving the above objectives. In one aspect these objectives are accomplished by making a single length-wise cut through a pipe wall in such a manner that the wall thickness, which is severed by the cut, is greater than the thickness of the pipe wall along a radius of the cylindrical pipe i.e., with reference to a cross-section of the slitted pipe, the slit is not aligned with a radius of the pipe.

In another aspect the slitted pipe is made from a composition comprising a synthetic resin so as to be impervious to harmful environments.

In a preferred embodiment, the cylindrical pipe to be slit is fed through a longitudinal bore in a supporting frame. Within the bore of the supporting frame there is provided an appropriately shaped mandrel for insertion into the inner diameter of the cylindrical pipe. The cutting edge of a knife is also positioned within the bore of the supporting frame so as to traverse the inner and the outer circumference of the cylindrical pipe as the pipe is advanced through the bore. With the cutting edge being positioned non-radially with respect to the bore in the frame, the thickness of the pipe wall that is severed is greater than the minimum wall thickness. For example, the cutting edge may be positioned tangentially to the circumference of the mandrel and extend downwardly from a point on the circumference of the mandrel so as to traverse the outer circumference of the pipe. In this embodiment, the thickness of the pipe which is severed by the cut through the pipe wall is the maximum thickness that can be severed in making a single cut through a pipe wall.

Other objects and advantages of the invention will be apparent from the foregoing brief description of the invention and the claims, as well as the following detailed description of the preferred embodiment of the invention as illustrated by the drawings in which:

DETAILED DESCRIPTION OF THE PREFERRED EMBODIMENT

This invention is illustrated and described in terms of a generally cylindrical plastic pipe and the invention is applicable to any size of plastic pipe. It is particularly applicable, however, to plastic pipe having a relatively thick wall. The invention also extends to slitting other suitable materials such as soft metals, cardboard, etc.

Figure 1:
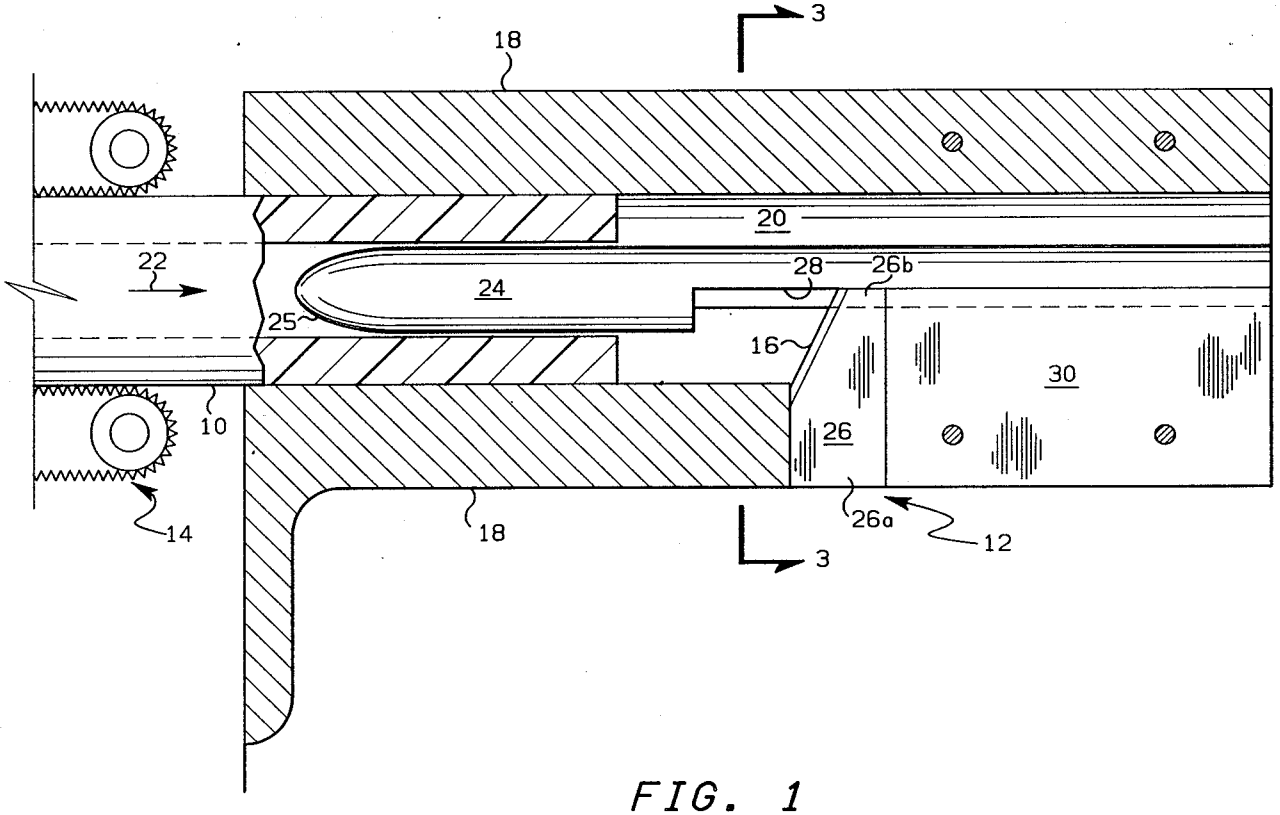
FIG. 1 is a side elevation, partly in section, illustrating a pipe entering a preferred embodiment of pipe slitting apparatus according to the invention.

Referring now to the drawing, FIG. 1 illustrates a pipe 10 entering a slitting apparatus, generally illustrated at 12. The pipe 10 may be constructed of any suitable material but is preferably formed from a composition comprising a synthetic resin. Still more preferably the synthetic resin is a polyolefin, such as polypropylene, polyethylene, and mixtures thereof. The pipe 10, therefore, is made of a material which is impervious to the ingress of any gas or vapor.

The plastic pipe 10 is illustrated leaving a pipe puller, generally illustrated at 14. The pipe leaving the puller 14 is in a state which can be described as semi-expandable, and with plastic memory. This state of the pipe is characterized by a temperature below the melting point, but not so far below the melting point that the material cannot be expanded and shrunk. The plastic pipe when expanded in this state and then allowed to shrink will tend to return to its original diameter, i.e. its diameter prior to being expanded.

The invention illustrated in FIG. 1 is shown in relation to a generally vertically oriented cutting edge 16, although other orientations of the cutting edge 16 can be utilized if desired. The illustrated invention relies upom a pipe puller 14 to feed the pipe 10 horizontally across the vertically oriented cutting edge 16. The cutting edge 16 is formed on a knife member 26, having a first end 26*a* and a second end 26*b*, which is carried by a frame 18 having a bore 20 therethrough. The pipe 10 enters the bore 20 at an entrance end of the bore 20 in a direction illustrated by the arrow 22. The bore 20 is sized so as to closely receive the outside diameter of the pipe 10. A mandrel 24 is positioned within the bore 20 along the longitudinal axis of the bore 20 for centering and supporting the pipe 10 as its wall is severed while advancing through the bore 20. The mandrel 24 generally includes at least a portion which is cylindrical in shape, and has a tapered end or leading edge 25 for inserting into the inner diameter of the pipe 10. Preferably the mandrel 24 is made of mild grade steel.

Figure 2:
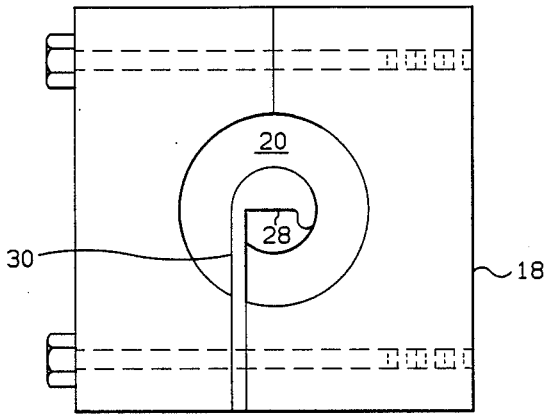
FIG. 2 is an end elevation view of the exit end of the pipe slitting apparatus illustrated in FIG. 1.
Figure 3:
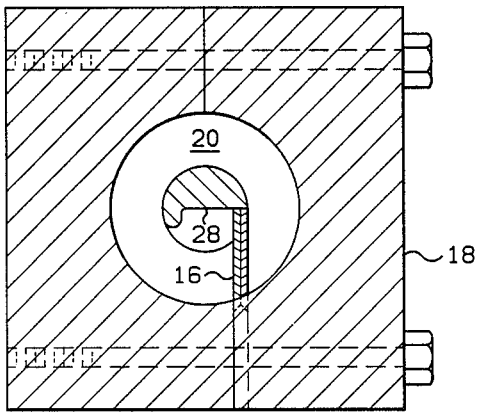
FIG. 3 is a sectional view taken along lines 3—3 in FIG. 1.

As best illustrated in FIGS. 1, 2, and 3, where like reference numerals are used for parts which appear in more than one figure, the cylindrical shape of the mandrel 24 is modified to provide a portion having a flat surface 28 to aid in mounting the mandrel 24 within the bore 20. A support member 30 for the mandrel 24 is rigidly carried by the frame 18 and, as illustrated, the support member 30 is rigidly attached to the flat surface 28 by known methods such as welding.

As best illustrated in FIG. 3 the cutting edge 16 of the knife 26 is positioned tangentially with respect to the circumference of the cylindrical portion of the mandrel 24 and extends downwardly from the outer surface of the mandrel 24 to intersect the circumference of the bore 20. The knife 26 is rigidly attached to the flat surface 28 of the mandrel 24 and frame 18 and, if desired, the knife 26 may be releasably attached to the frame 18 and the flat surface 28 by any known means.

As the pipe 10 advances over the cutting edge 16 and the support member 30 the slit cut in the pipe wall must spread sufficiently to allow passage of the pipe. As the pipe moves beyond the exit end 32 of the bore 20, however, the slit closes and the pipe returns to its original shape due to the plastic memory of the pipe.

Referring now to FIG. 5, there are illustrated four cross-sectional view of slitted pipe. FIG. 5A illustrates a slit 44 aligned with a radius of a pipe 42, made in accordance with the prior art. FIG. 5B illustrates a gap 46 which occurs when a diameter of the pipe 42, which is slitted as illustrated in FIG. 5A, is expanded. FIGS. 5C and 5D, illustrate a pipe slit in accordance with the present invention, wherein a diameter of the pipe 48 can be expanded without creating a gap at the slit 50 as shown in FIG. 5D.

The cutting edge 16 illustrated in FIGS. 1 and 3 can be of any known cuttting shape having a sharp finish. For example the edge can be a single angled cutting edge similar to a wood chisel, or a dual angle cutting edge similar to a safety razor. The essential requirements of the cutting edge are of having sufficient rigidity and sharpness with minimal thickness to easily slice through the walls of the pipe without obstructing operation of the pipe puller. Preferably the cutting edge is formed from tool steel.

Figure 4:
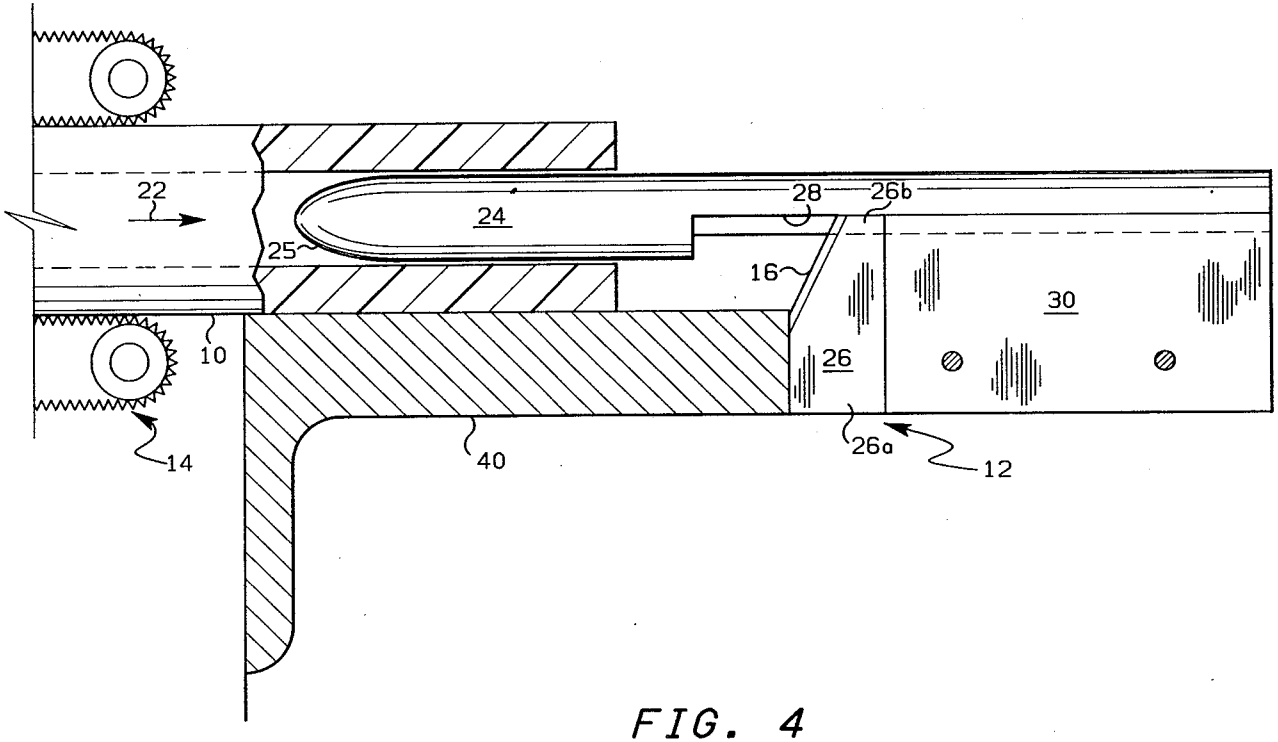
FIG. 4 is a side elevation, partly in section illustrating a pipe entering an alternate embodiment of pipe slitting apparatus according to the invention.
Figure 5A:
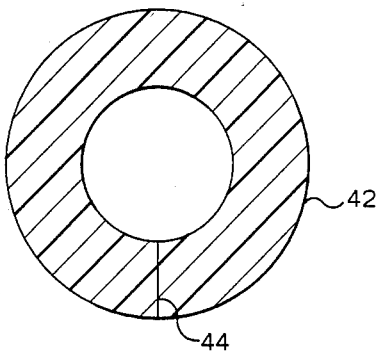
FIGS. 5A and 5B are prior art cross-sectional views of slitted pipe in a relaxed condition.
Figure 5C:
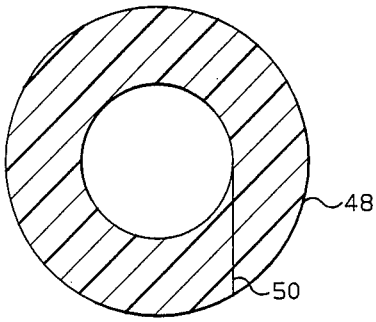
FIG. 5C PRIOR ART
FIGS. 5C and 5D are cross-sectional views of slitted pipe according to the invention.
Figure 5B:
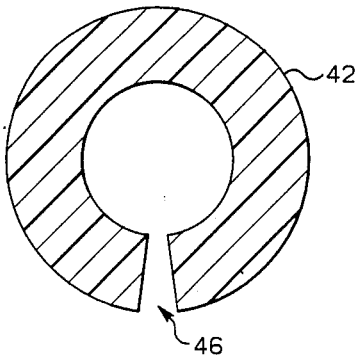
Figure 5D:
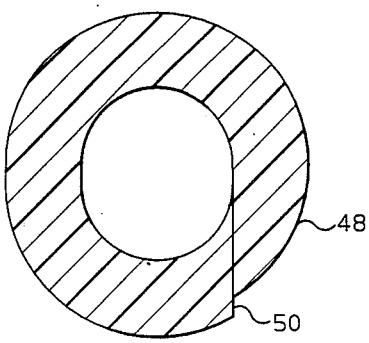

An alternate arrangement of apparatus for the practice of the invention is illustrated in FIG. 4. In this embodiment the frame 18 having a bore which matches the outside diameter of the pipe 10, is replaced by a flat support plate 40. Otherwise operation of the slitting apparatus is identical as described in reference to FIG. 1. It is contemplated that this arrangement of parts illustrated in FIG. 4 would be suitable for plastic pipes in a state of sufficient rigidity that the support provided by the bore 20 in the frame 18 is unnecessary. Further, if desired, the knife 26 may be maintained at an elevated temperature by an external heating source, such as hot air, electrical heating, etc. The higher temperature reduces friction and therefore aids in cutting the wall of the pipe.

Slitting of a wall of a tubular piece having an inner diameter and an outer diameter is accomplished as the tubular piece advances through a supporting frame, having a longitudinal bore extending therethrough from an entrance end to an exit end for closely receiving and passing the tubular piece. This slitting operation requires positioning a mandrel, having a cylindrical portion and a tapered leading edge, in alignment with a longitudinal axis of the bore through the supporting frame, with the leading edge of the mandrel being inserted into the inner diameter of the tubular pipe. Also required in this operation is the positioning of the cutting edge so as to face the entrance end of the bore with the cutting edge being positioned non-radially with respect to the bore in the supporting frame. In an alternate embodiment for slitting pipes of sufficient rigidity, the pipe support provided by the bore in the frame may not be required and the frame may be replaced with a flat support plate. In this event the knife edge is positioned so as to face the tapered leading edge of the mandrel and is securely attached at one end to the mandrel at a point on the horizontal diameter of the mandrel that is removed from the midpoint the horizontal diameter. The other end of the knife being attached to the flat support plate.

While the invention has been described in reference to a preferred embodiment as illustrated in FIGS. 1–5, variations and modifications of the present invention will be apparent to one skilled in the art and accordingly, the invention is to be limited only in accordance with the appended claims.

That which is claimed is:

1. Apparatus for cutting a single slit along the length of a tubular piece having an inner diameter and an outer diameter, said apparatus comprising:

a frame having a bore extending longitudinally therethrough from an entrance end to an exit end for closely receiving and passing the outer diameter of the tubular piece therethrough;

a mandrel fixedly positioned in the bore of said frame along a longitudinal axis of the bore and having a cylindrical portion including a tapered leading edge for closely inserting into the inner diameter of the tubular piece;

a knife member, having a first end, a second end and a cutting edge positioned in the bore of said frame;

wherein the cutting edge of said knife member faces the entrance end of the bore in said frame, the first end of said knife member being attached to said frame and the second end of said knife member being attached to said mandrel, and wherein the cutting edge is positioned non-radially with respect to the bore of said frame; and means for feeding the tubular piece through the bore of said frame whereby the tubular piece is centered in the bore of said frame by said mandrel and is cut by the cutting edge of said knife member.

2. Apparatus in accordance with claim 1, wherein said means for feeding the tubular piece comprises a pipe puller.

3. Apparatus in accordance with claim 1, wherein said knife member is formed of tool steel, and said mandrel is formed of a mild grade steel.

4. Apparatus for lengthwise severing a wall thickness of a tubular piece said apparatus comprising:

a mandrel having a cylindrical portion including a tapered leading edge for inserting into the bore of a tubular piece to be severed, wherein the bore of the tubular piece closely receives the cylindrical portion of said mandrel;

wherein an essentially circular cross-section of the cylindrical portion of said mandrel defines a horizontal diameter of the cylindrical portion of said mandrel;

a knife member having a first end, a second end and a cutting edge;

a generally horizontally disposed base for supporting said mandrel and said knife member;

wherein the cutting edge of said knife member faces the tapered leading edge of said mandrel, the second end of said knife member being securely attached to said mandrel at a point on the horizontal diameter of said mandrel that is removed from the midpoint of the horizontal diameter, and the first end of said knife member being securely attached to said base, and means for feeding the tubular piece onto said mandrel and through the cutting edge of said knife member, whereby the tubular piece is supported by said mandrel while being severed by the cutting edge of said knife member.

5. Apparatus comprising:

a tubular piece having an inner diameter and an outer diameter;

a frame having a bore extending longitudinally therethrough from an entrance end to an exit end for closely receiving and passing the outer diameter of the tubular piece therethrough;

a mandrel fixedly positioned in the bore of said frame along a longitudinal axis of the bore and having a cylindrical portion including a tapered leading edge for closely inserting into the inner diameter of said tubular piece;

a knife member, having a first end, a second end and a cutting edge, said knife member being positioned in the bore of said frame;

wherein the cutting edge of said knife member faces the entrance end of the bore in said frame, the first end of said knife member being attached to said frame and the second end of said knife member being attached to said mandrel, and wherein the cutting edge is positioned non-radially with respect to the bore of said frame; and means for feeding the tubular piece through the bore of said frame whereby the tubular piece is centered in the bore of said frame by said mandrel and is cut by the cutting edge of said knife member.

6. Apparatus in accordance with claim 5 wherein said tubular piece is formed of a composition comprising a synthetic resin.

7. Apparatus in accordance with claim 6 wherein said synthetic resin is polypropylene.

8. Apparatus in accordance with claim 6 wherein said synthetic resin is polyethylene.

9. Apparatus in accordance with claim 7, wherein said tubular piece comprises a plastic pipe in a semi-expandable state having plastic memory.

10. A method comprising the steps of:

positioning a mandrel, having a cylindrical portion and a tapered leading edge, in alignment with a longitudinal axis of a bore through a supporting frame;

positioning the cutting edge of a knife member so as to traverse a portion of the bore from the mandrel to the supporting frame, the cutting edge facing the entrance end of the bore, and being positioned non-radially with respect to the bore;

inserting the tapered leading edge of the mandrel into an inner diameter of a tubular piece, having an inner diameter and an outer diameter, as the tubular piece advances through the bore in the supporting frame; and feeding the tubular piece through the bore of the supporting frame whereby the tubular piece is centered in the bore of said frame by said mandrel and is cut by the cutting edge of the knife member.

11. Method in accordance with claim 10 wherein the tubular piece is formed of a composition comprising a synthetic resin.

12. Method in accordance with claim 11 wherein the synthetic resin is polypropylene.

13. Method in accordance with claim 11 wherein the synthetic resin is polyethylene.

14. Method in accordance with claim 10 wherein the tubular piece comprises a plastic pipe in a semi-expandable state having plastic memory.

15. Method in accordance with claim 10, additionally comprising the step of:

maintaining the knife member at elevated temperature in relation to the tubular piece.

* * * * *